US005427380A

United States Patent [19]

Hazard et al.

[11] Patent Number: 5,427,380

[45] Date of Patent: Jun. 27, 1995

[54] HAND-HELD MULTI-FUNCTION WIRELESS TARGET CONTROL SYSTEM

[75] Inventors: Bowdien H. Hazard, Austin; Tolman Jay, Leander, both of Tex.

[73] Assignee: Interactive Innovations, Inc., Austin, Tex.

[21] Appl. No.: 325,691

[22] Filed: Oct. 19, 1994

[51] Int. Cl.[6] ..... F41J 9/18

[52] U.S. Cl. ..... 273/362; 124/32; 124/34; 273/406

[58] Field of Search ..... 273/362, 371, 406; 124/32, 34

[56] References Cited

U.S. PATENT DOCUMENTS

| | | | |
|---|---|---|---|
| 1,903,667 | 4/1933 | Band | 124/32 X |
| 1,989,452 | 1/1935 | Joy | 124/32 X |
| 2,855,916 | 10/1958 | Foster | 124/32 |
| 3,568,199 | 3/1971 | Hartness | 124/32 X |
| 3,722,495 | 3/1973 | Hansen | 124/32 X |
| 3,739,379 | 6/1973 | Liming et al. | 124/34 X |
| 3,874,670 | 4/1975 | Weihl | 273/406 |
| 3,914,879 | 10/1975 | Taylor, III et al. | 273/406 X |
| 4,222,564 | 9/1980 | Allen et al. | 273/369 |
| 4,889,346 | 12/1989 | Destry et al. | 273/406 |
| 5,088,741 | 2/1992 | Simonetti | 273/410 |
| 5,379,576 | 10/1994 | Bunner et al. | 124/34 X |

OTHER PUBLICATIONS

Compak ® Sporting International Rules. pp. 1–4. Date unknown.

NSCA 5-Stand Sporting Clays. Rules, Equipment and Requirements. From the National Sporting Clays Association, San Antonio, Texas. Date unknown.

Getting Started–Second in a Series. "Clay Target Shooting". From Ducks Unlimited; by Matt Young. Apr. 1994.

Selected pp. 15, 17, 23, 46, 47 and 78 from "Sporting Clays–The Shotgun Hunter's Magazine". Mar.–Apr. 1992. vol. IV–No. II. Apr. 1992.

*Primary Examiner*—William H. Grieb

*Attorney, Agent, or Firm*—Schwegman, Lundberg & Woessner

[57] ABSTRACT

A hand-held multi-function target presentation control system with interchangeable operator control modules for communicating with at least one wireless target control modules. The operator control module having a user interface for selectively controlling a plurality of stations, each station having at least one target launch machine, for inputting and tracking a plurality of shooters, and for inputting a target launch sequence and a score for each shooter.

13 Claims, 8 Drawing Sheets

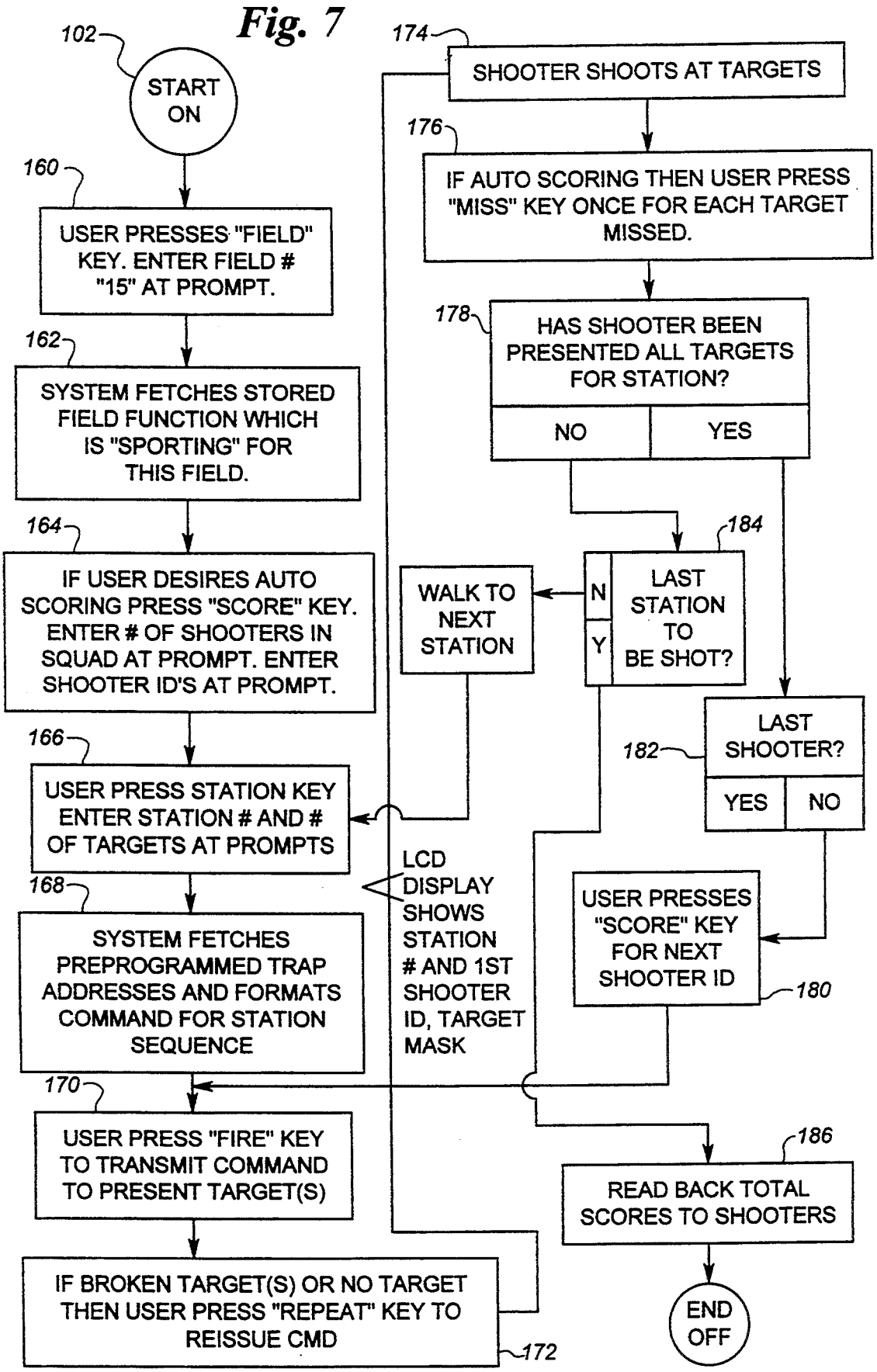
Fig. 7
102
START ON
160
USER PRESSES "FIELD" KEY. ENTER FIELD # "15" AT PROMPT.
162
SYSTEM FETCHES STORED FIELD FUNCTION WHICH IS "SPORTING" FOR THIS FIELD.
164
IF USER DESIRES AUTO SCORING PRESS "SCORE" KEY. ENTER # OF SHOOTERS IN SQUAD AT PROMPT. ENTER SHOOTER ID'S AT PROMPT.
166
USER PRESS STATION KEY ENTER STATION # AND # OF TARGETS AT PROMPTS
168
SYSTEM FETCHES PREPROGRAMMED TRAP ADDRESSES AND FORMATS COMMAND FOR STATION SEQUENCE
170
USER PRESS "FIRE" KEY TO TRANSMIT COMMAND TO PRESENT TARGET(S)
IF BROKEN TARGET(S) OR NO TARGET THEN USER PRESS "REPEAT" KEY TO REISSUE CMD
172
174
SHOOTER SHOOTS AT TARGETS
176
IF AUTO SCORING THEN USER PRESS "MISS" KEY ONCE FOR EACH TARGET MISSED.
178
HAS SHOOTER BEEN PRESENTED ALL TARGETS FOR STATION?
NO
YES
184
LAST STATION TO BE SHOT?
N
Y
WALK TO NEXT STATION
LCD DISPLAY SHOWS STATION # AND 1ST SHOOTER ID, TARGET MASK
182
LAST SHOOTER?
YES
NO
USER PRESSES "SCORE" KEY FOR NEXT SHOOTER ID
180
186
READ BACK TOTAL SCORES TO SHOOTERS
END OFF

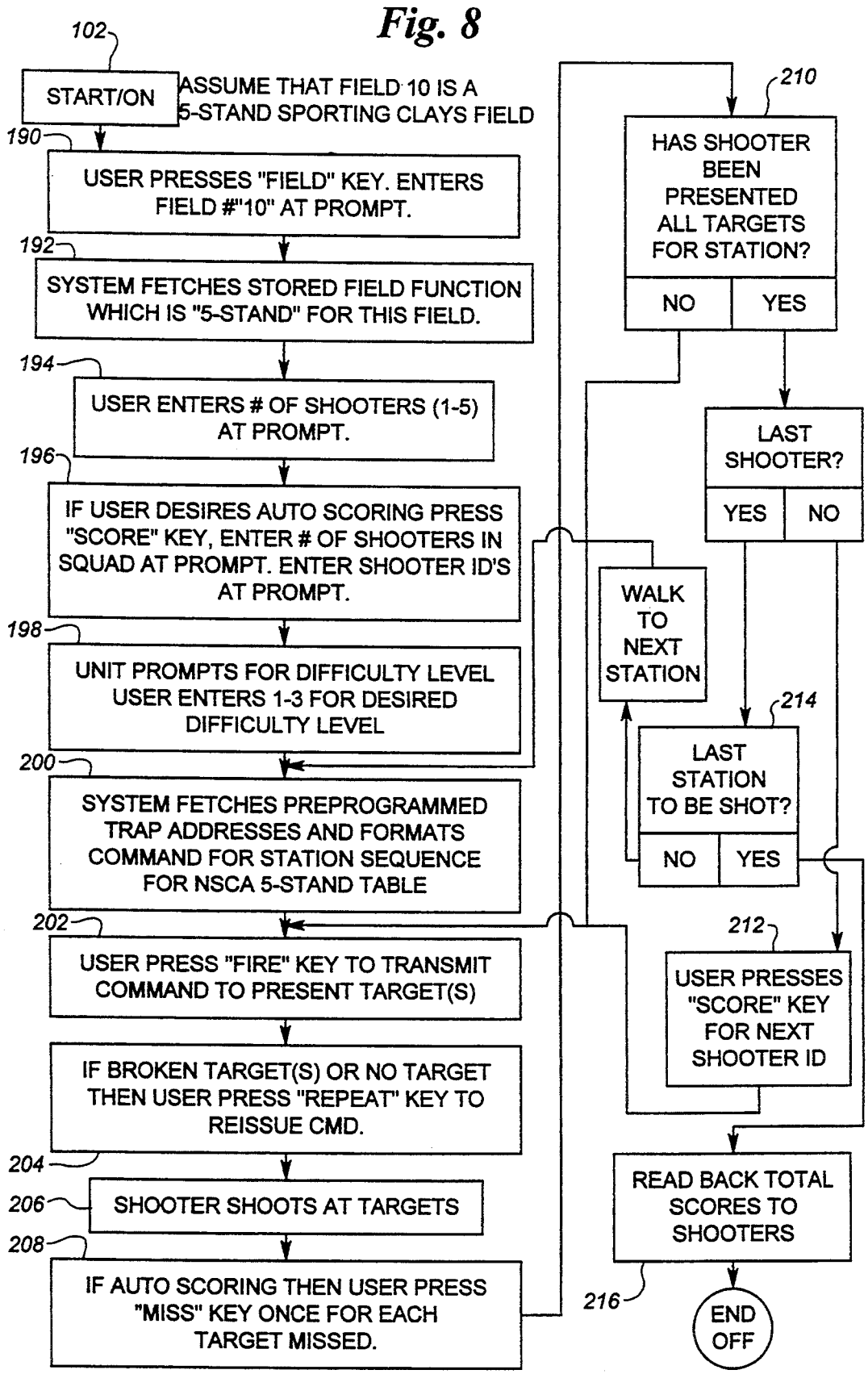
Fig. 8
102
START/ON
ASSUME THAT FIELD 10 IS A 5-STAND SPORTING CLAYS FIELD
190
USER PRESSES "FIELD" KEY. ENTERS FIELD #"10" AT PROMPT.
192
SYSTEM FETCHES STORED FIELD FUNCTION WHICH IS "5-STAND" FOR THIS FIELD.
194
USER ENTERS # OF SHOOTERS (1-5) AT PROMPT.
196
IF USER DESIRES AUTO SCORING PRESS "SCORE" KEY, ENTER # OF SHOOTERS IN SQUAD AT PROMPT. ENTER SHOOTER ID'S AT PROMPT.
198
UNIT PROMPTS FOR DIFFICULTY LEVEL USER ENTERS 1-3 FOR DESIRED DIFFICULTY LEVEL
200
SYSTEM FETCHES PREPROGRAMMED TRAP ADDRESSES AND FORMATS COMMAND FOR STATION SEQUENCE FOR NSCA 5-STAND TABLE
202
USER PRESS "FIRE" KEY TO TRANSMIT COMMAND TO PRESENT TARGET(S)
IF BROKEN TARGET(S) OR NO TARGET THEN USER PRESS "REPEAT" KEY TO REISSUE CMD.
204
206
SHOOTER SHOOTS AT TARGETS
208
IF AUTO SCORING THEN USER PRESS "MISS" KEY ONCE FOR EACH TARGET MISSED.
210
HAS SHOOTER BEEN PRESENTED ALL TARGETS FOR STATION?
NO
YES
LAST SHOOTER?
YES
NO
WALK TO NEXT STATION
214
LAST STATION TO BE SHOT?
NO
YES
212
USER PRESSES "SCORE" KEY FOR NEXT SHOOTER ID
READ BACK TOTAL SCORES TO SHOOTERS
216
END OFF

HAND-HELD MULTI-FUNCTION WIRELESS TARGET CONTROL SYSTEM

FIELD OF THE INVENTION

The present invention relates to a hand-held system, and more particularly, to an interchangeable wireless target control system with a user interface for selectively controlling a plurality of stations, each station having at least one target launch machine, for inputting and tracking a plurality of shooters, and for inputting a target launch sequence and a score for each shooter. Each operator control unit has the capability of controlling the target launch machines on multiple fields or courses, thereby making operator control units interchangeable in the case of unit failure.

BACKGROUND OF THE INVENTION

As wildlife stocks diminish and bag limits on waterfowl decrease, a variety of systems have been created to help hunters improve their shooting skills. For example, beginning waterfowlers can gain experience shooting clay targets. Moreover, mechanized target launchers provide for a structured and repeatable shooting environment that is conducive to sporting competitions, military, and law enforcement firearms training.

A variety of formats exist for clay target shooting, including trap, skeet, and sporting clays. Additionally, many formats for handgun and rifle competition and training also exist.

For example, an official trap shooting course consists of five shooting stations arranged three yards apart in a semi-circle, beginning sixteen yards behind a sunken trap house facing away from the shooter. Clay targets are thrown at a rising angle away from the shooter, much like a flushing pheasant. A round of trap consists of shooting at five targets from each of the five shooting stations. For increased difficulty, shooters can stand further behind the trap house or shoot doubles (two targets thrown simultaneously).

A round of skeet shooting includes 25 targets thrown from trap towers at different heights. The two towers, known as the lower house and the higher house, face each other across an open field. Both towers throw targets at the same speed and trajectory, but at different heights. A skeet course consists of seven shooting stations arranged in a half circle and an eighth station positioned directly between the two towers. During a round, the shooter receives one target from both houses at each of the eight stations. The shooter then takes a double throw (two targets simultaneously) launched by both houses at station numbers 1, 2, 6 and 7. If a shooter has scored a perfect round, he receives a final target thrown from the lower house at station 8. Otherwise he must shoot from the location of his first miss.

While trap and skeet shooting have standardized course designs, every sporting clays course is unique. Designers use natural features such as ponds, wooden ravines, and hedge rows to create shooting stations that closely simulate hunting for game such as ducks, quail, pheasants, grouse, doves, and rabbits. For example, a very popular station found on many courses is known as the "duck blind" where a shooter waiting in a boat or blind must hit targets descending over a pond like a landing mallard.

A round of sporting clays includes as many as 100 targets, most of which are doubles. The doubles may be simultaneous doubles in which two targets are thrown at once, trailing pairs in which the release of the second target is briefly delayed, and report doubles in which the second target is thrown immediately after the first shot.

There are several other formats for sporting clay courses including NSCA, 5-STAND SPORTING, FITASC, COMPAK SPORTING, which use various target presentation sequences and require less land area. The rules for COMPAK and NSCA 5-STAND Sporting Clays are hereby incorporated by reference.

The use of specialty targets also adds to the challenge of sporting clays. For example, medium sized "midi" targets and small "mini" targets are thrown to challenge the shooters depth perception. Other specialty targets include the wafer thin "butte" which twists and turns in flight like a dove, the "rabbit" which bounces and skids on the ground, and the "rocket" which is fast flying and difficult to break.

The typical sporting clays course may have a dozen or more shooting stations, with multiple target machines on each station. Moreover, a typical shooting competition may have hundreds of competitors, each having an individual target launch sequence to be controlled and scored. Therefore, there is a need for a method and apparatus for automatically controlling multiple target machines at multiple stations, and for tracking and scoring large numbers of shooters.

However, current methods and systems for controlling the launch of targets are hard wired to each of the launchers. Some of the current systems are operated by a central computer interface that is located at a fixed location relative to the shooting stations. These systems lack a user interface which is portable and easy to use. Also these systems lack a remote score keeping capability or the ability to modify the program parameters. Finally, if the central computer fails, the entire course and/or competition is halted until the system is repaired.

SUMMARY OF THE INVENTION

The present invention relates to a hand-held multi-function wireless target control system for presenting shooting targets according to a operator entered pre-programmed sequence or individual commands entered at a user interface.

The target control system comprises a wireless, hand-held operator control module for communicating commands to a target machine control module. The target machine control module activates one or more target launch machines for presenting targets according to commands entered in the operator control module. The operator control module and target machine control module preferably communicate by narrow band FM transmissions.

The operator control modules preferably are interchangeable so that any operator control module may communicate with any target machine control module.

The operator control module includes a user interface for inputting program sequence data to selectively control a plurality of stations, each station having at least one associated target machine. The user interface allows for inputting and tracking a plurality of shooters, each shooter having a declared standard or personalized target launch sequence. Score for each shooter also are input through the user interface.

The radio frequency receiving and transmitting system connecting the operator control module and the target machine control module includes either a uni-directional protocol or a bi-directional protocol that verifies receipt of commands and/or the return of score data for targets which have hit sensors, such as some current handgun and rifle target systems. The uni-directional protocol uses an error-detection method, such as a check sum method of command verification, whereby only commands with valid check sums are executed by the target machine control module. The uni-directional protocol is used primarily in clay target presentations where the user can reissue the launch command by using the "REPEAT" key on the operator control module keypad if no target is launched.

The operator control module preferably includes a communication port for uploading and downloading to an optional central computer. The target machine control module communication port allowing the loading of new control functions or configuration firmware from a central computer.

BRIEF DESCRIPTION OF THE DRAWINGS

FIG. 7 is a top level flow chart illustrating an exemplary target presentation execution sequence for a sporting clays course; and FIG. 8 is a top level flow chart illustrating an exemplary target presentation execution sequence for a 5-stand sporting clays field.

DETAILED DESCRIPTION OF THE PREFERRED EMBODIMENTS

Figure 1:
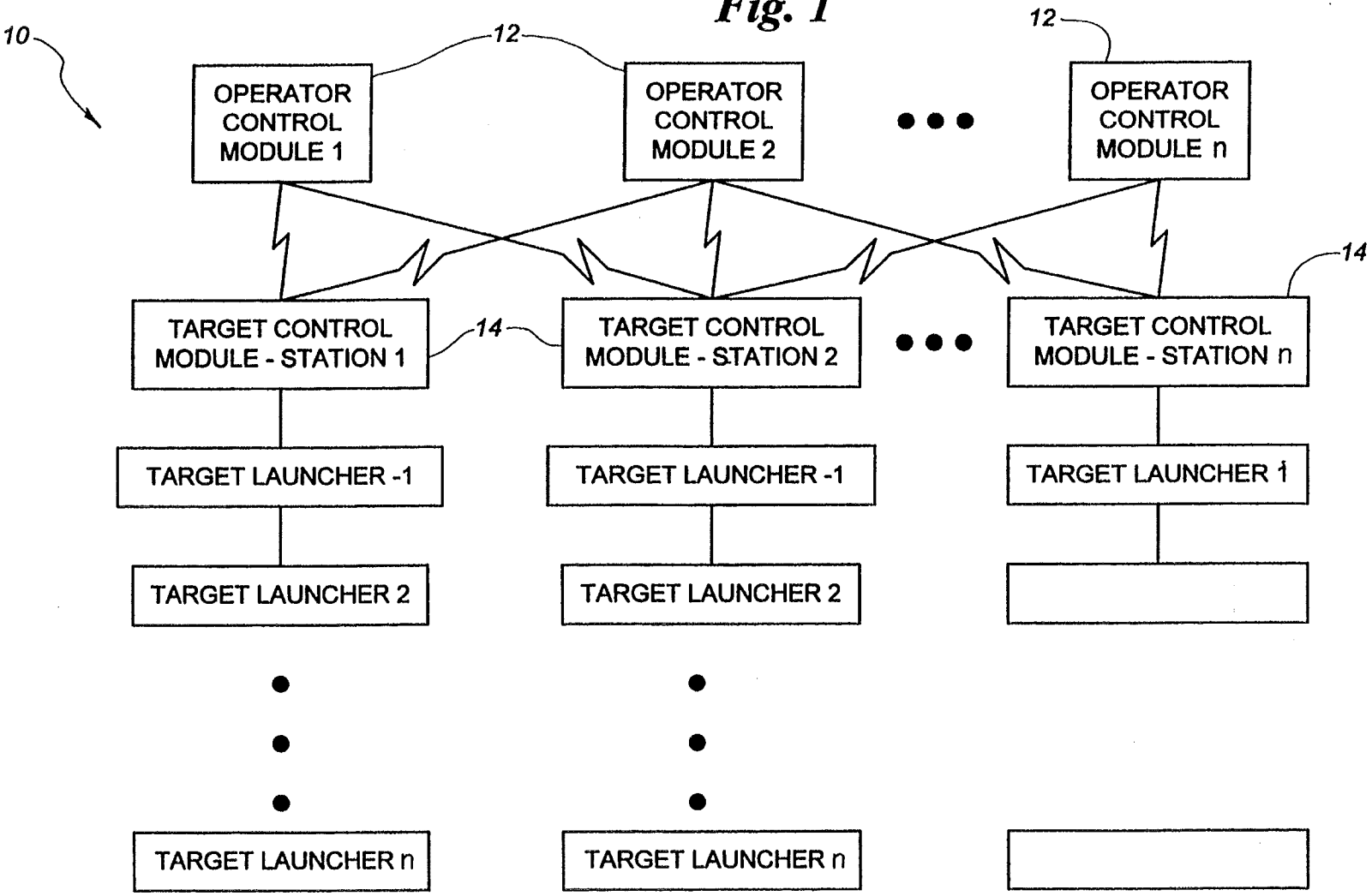
FIG. 1 is a schematic illustration of the present multi-function wireless target control system.

FIG. 1 is a schematic illustration of the present multi-function wireless target control system 10. Hand-held operator control modules 12 (1, 2,...n) communicated with any of a number of target machine control modules 14 (1, 2,...n) to control a plurality of target launchers 16. Since the hand-held operator control modules 12 can operate any of the target control modules 14, the system 10 can continue to operate as long as at least one control modules 12 is operational.

Figure 2:
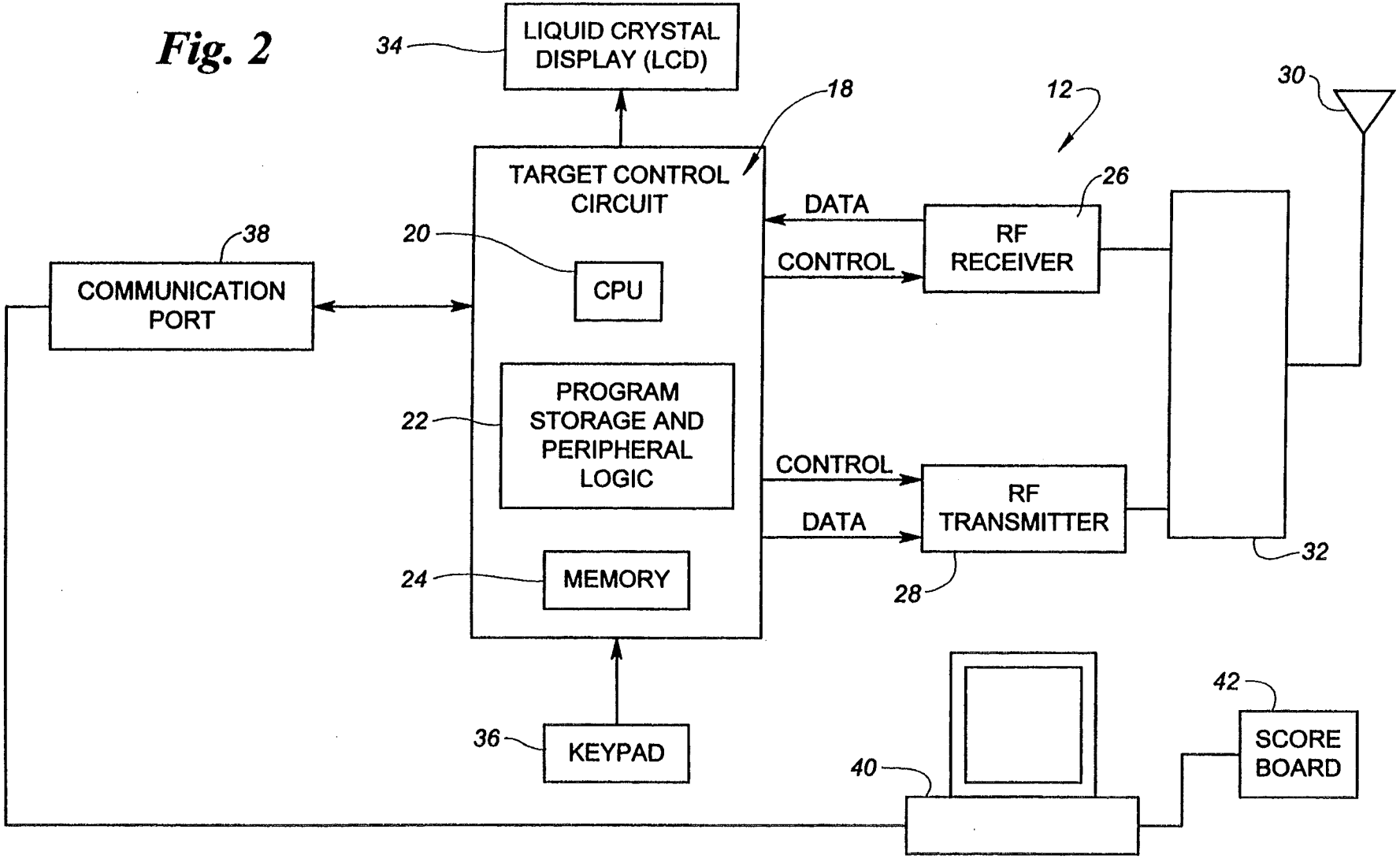
FIG. 2 is a block diagram illustrating a preferred operator control module of the multi-function wireless target presentation control system.

FIG. 2 is a schematic illustration of a operator control module 12 of the present multi-function wireless target control system 10. A target control circuit 18 having a CPU 20, program storage and peripheral logic 22, and nonvolatile memory 24 is connected to a power source (not shown). The target control circuit 18 communicates with any target control module (See FIG. 2) through an optional radio receiver 26 and radio transmitter 28. The radio receiver and transmitter 26, 28 are connected to an antenna 30 through a transmit/receive network 32.

The radio receivers and transmitters 26, 26' 28, 28' utilize either a uni-directional protocol or a bi-directional protocol that verifies receipt of commands. The transmitter 28' may also return score data for targets which have hit sensors using a bi-directional protocol format. It will be understood that a variety of optical hit sensors known in the art may by used with the present wireless target machine control system.

The uni-directional protocol uses a command verification method, such as a check sum, so that only valid commands are executed by the target machine control module 14. The uni-directional protocol preferably is used in clay target presentations where the user can reissue the launch command by using the "REPEAT" key on the operator control module keypad 36 if no target is launched (see FIG. 4).

The FM (frequency modulation) band assigned to the present system 10 is between 46–49 megahertz (MHz). In particular, the hand-held operator control module 12 is anticipated to receive in a frequency band between 46.61–46.97 MHz and transmit in a band between 49.67–49.97 MHz. In a preferred embodiment, a narrow band FM transmitting circuit, instead of a gated transmitting circuit, is utilized for better noise immunity, to reduce interference, and to provide greater range at a given power level. It will be understood that a variety of other electro-magnetic frequency bands may be suitable for the present invention, such as 900 MHz spread spectrum technology used with cordless phones.

The operator control module 12 includes a user interface (see FIG. 4) comprising a liquid crystal display 34 and a key pad 36. Additionally, a communication port 38 is provided for connecting the operator control module 12 to an optional central computer 40. In a preferred embodiment, the communication port 38 may be used for either uploading or downloading data so that the operator control module 12 may be configured or scoring data retrieved directly using the central computer 40. Additionally, the optional central computer 40 may tabulate the scores of the shooters and display the scores on an electronic scoreboard 42. The preferred communication port 38 is a standard RS-232*c* configuration, although it will be understood that a variety of suitable interfaces exist.

Figure 3:
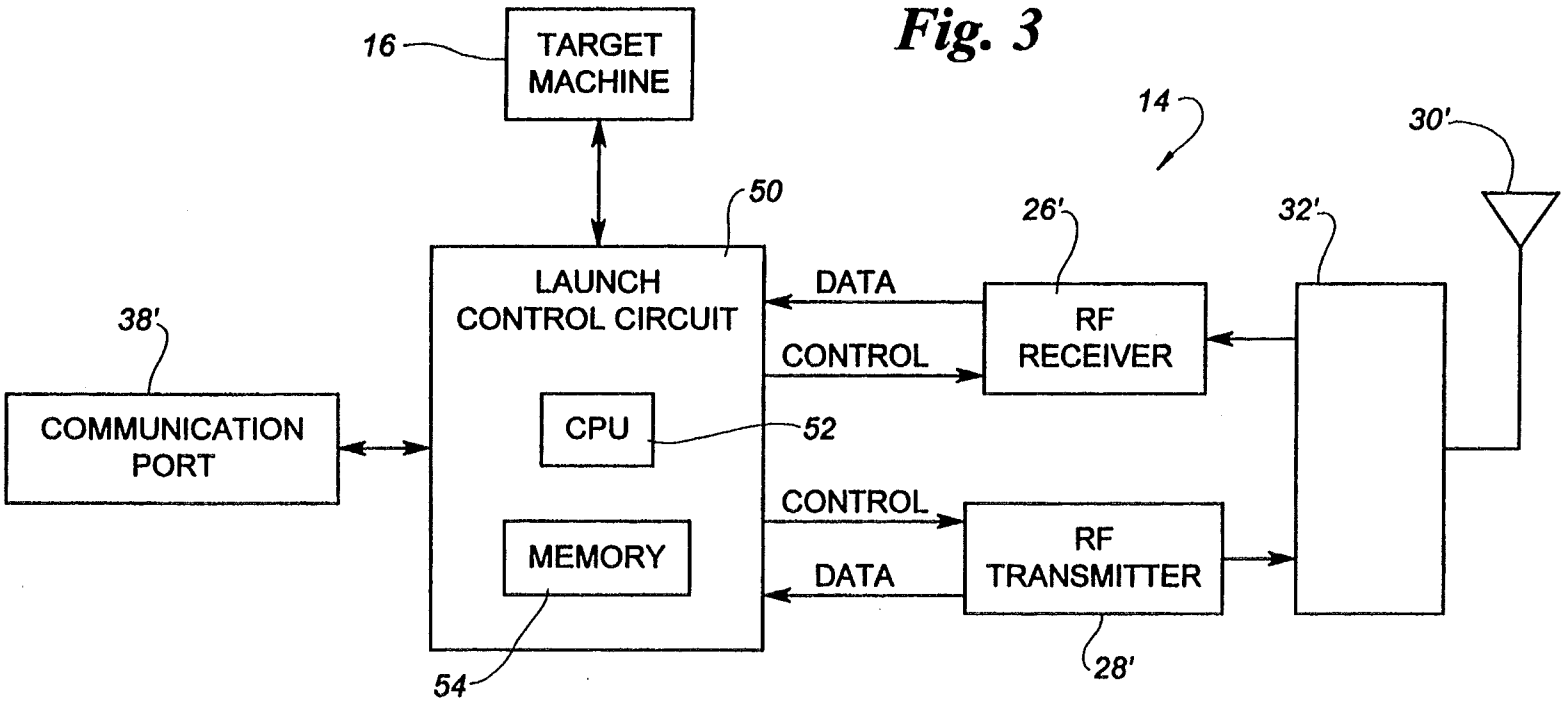
FIG. 3 is a block diagram illustrating a preferred target machine control module.

FIG. 3 illustrates a preferred target machine control module 14 for communicating with the operator control module 12. A launch control circuit 50 including a CPU 52 and memory 54 is connected to a power source (not shown). Alternatively, the target machine control module 14 may operate off the power provided to the target launch machine 16 (see FIG. 1). A radio frequency receiver 26' and optional transmitter 28' are connected to an antenna 30' through a transmit/receive network 32' to communication with the operator control module 12. The launch control circuit 50 is connected to a target launch machine 16 (see FIG. 1) for initiating the presentation of targets. A communications port 38' may be included for connecting the target machine control module 14 to a central computer (not shown) for programming and other functions.

Figure 4:
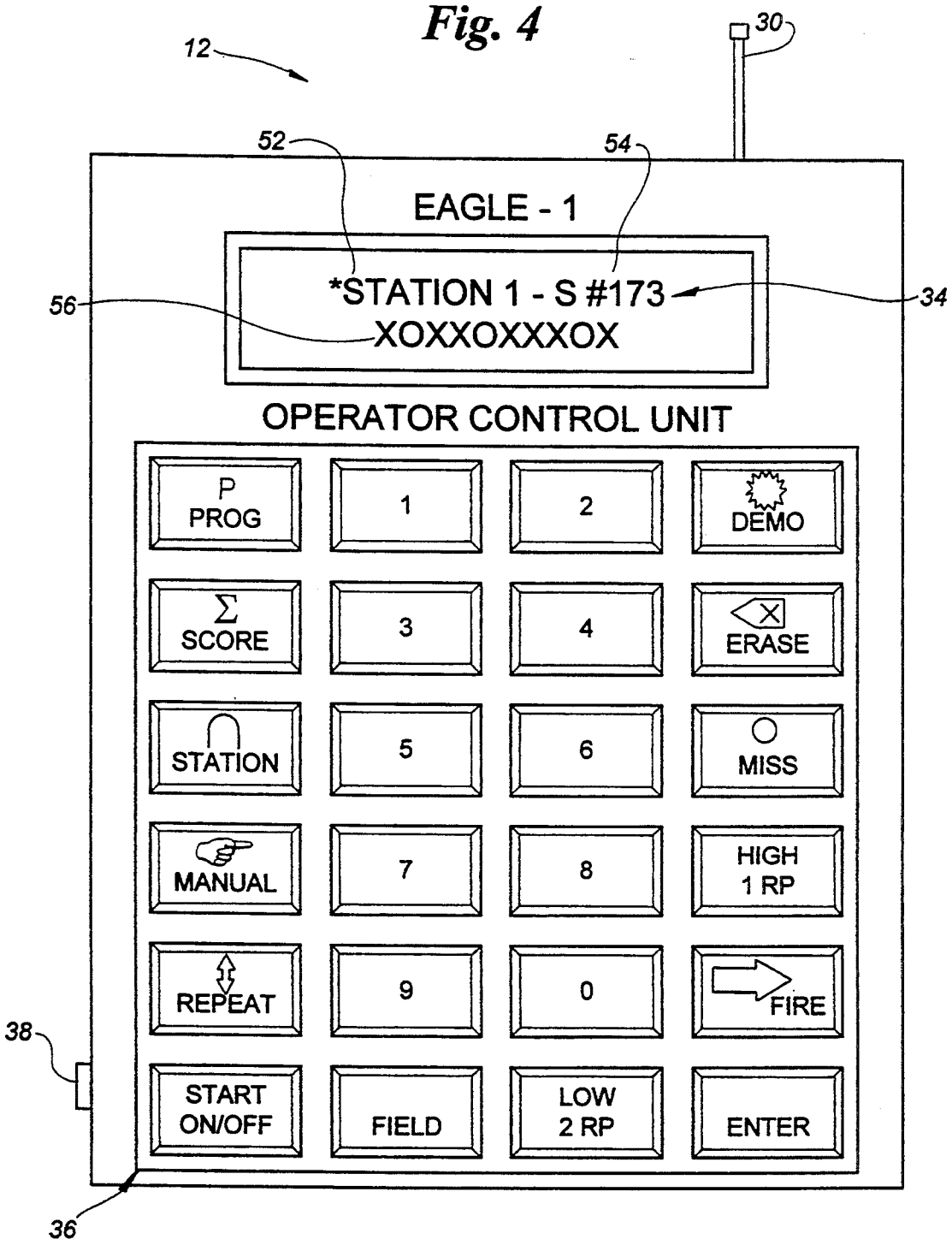
FIG. 4 is an illustration of a preferred user interface keypad and display for the operator control module.

FIG. 4 illustrates an exemplary user interface of a preferred operator control module 12. The dimensions of the operator control module 12 preferably are 3.75 inches wide by 6.76 inches long by 2.0 inches thick, and weighs approximately 0.5 pounds. The liquid crystal display 34 identifies the station 60 activated and the shooter 62 at that station, as well as the scoring information 64 where an "X" indicates a "hit" target and an "O" indicates a "missed" target. Upon completion of round or station, the operator may display each shooter's completed score results for verification.

The user interface also includes a key pad 34 which allows the operator to activate any target machines at any station in any order or according to a preprogrammed sequence. While the keys are self-explanatory, some will be discussed in further detail below in connection with the programming and operation of the operator control module 12.

In a preferred embodiment, the operator control module 12 can track and control up to 10 target machines per small area field such as NSCA 5-STAND SPORTING, SKEET, TRAP and HANDGUN shooting courses. Large area sporting clay and rifle courses may have with up to 15 stations per field, with a maximum of 30 target machines 16 per field. The operator control module 12 supports a total of 64 fields in any of the above mentioned formats. Additionally, a preferred operator control module 12 can track up to 1,000 shooters and their scores by target (hit, miss, or value). A running total of targets presented is also recorded and may be provided at completion of the competition for management analysis. It will be understood that the capacity of the preferred multi-function wireless target control system 10 does not limit the scope of the present invention.

Figure 5:
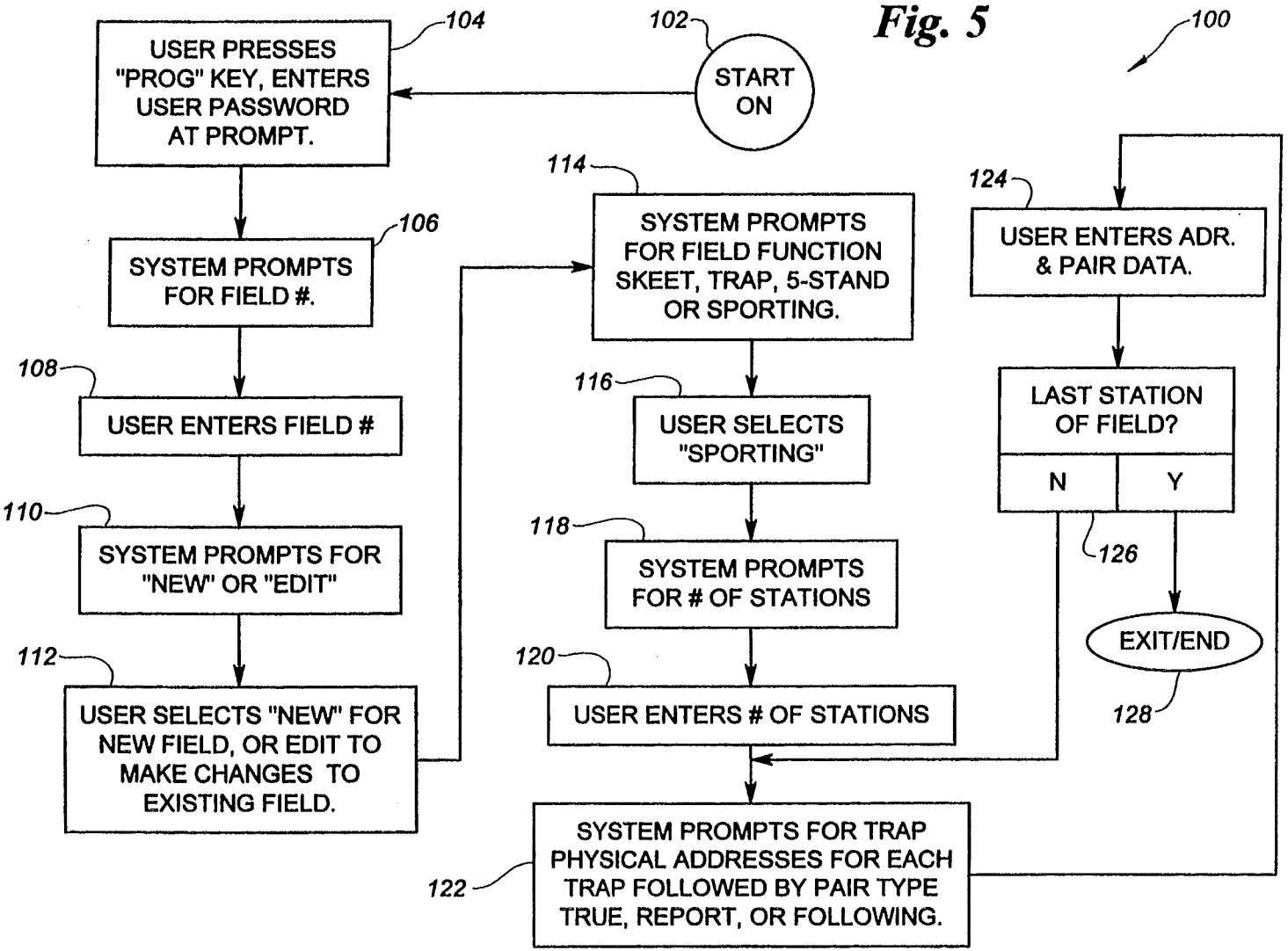
FIG. 5 is a top level flow chart illustrating a preferred method of programming a target presentation sequence into the wireless target control system operator module.

FIG. 5 is a top level flow chart illustrating an exemplary method of programming a target presentation sequence 100 into the hand-held operator control module 12. The user first presses the START ON/OFF key 102, followed by the PROG key 104. Numeric data is input through the numeric portion (1, 2, 3, ...0) of the keypad 36. The ENTER key enters the data into the system 12. The ERASE key may be used to alter previously entered data.

The system 12 prompts the user for a password. The system 12 then prompts the user for a field number 106. The user enters the field number 108 and the system 12 prompts the user to determine whether a new sequence is to be entered or an existing sequence is to be edited 110. After the user selects either 'new' for a new field or 'edit' for changes to an existing field 112, the system 12 prompts for a particular field function, such as skeet, trap, 5-stand or sporting 114.

For purposes of the example in FIG. 5, the user selects sporting 116. The system 12 then prompts the user for the number of stations 118 and the user enters the number of stations 120. The system 12 then prompts the user for the trap physical addresses for each trap 122 to be used in the target presentation sequence 100. The physical addresses for the trap requires an identification for the pair types, such as a true pair thrown simultaneously, a report pair in which the second target is thrown immediately after the first shot, or a following pair in which the launch of the second target is briefly delayed. The user then enters the address and pair data 124 for each station. After the last station has been programmed 126, the programming sequence is completed 128.

Figure 6:
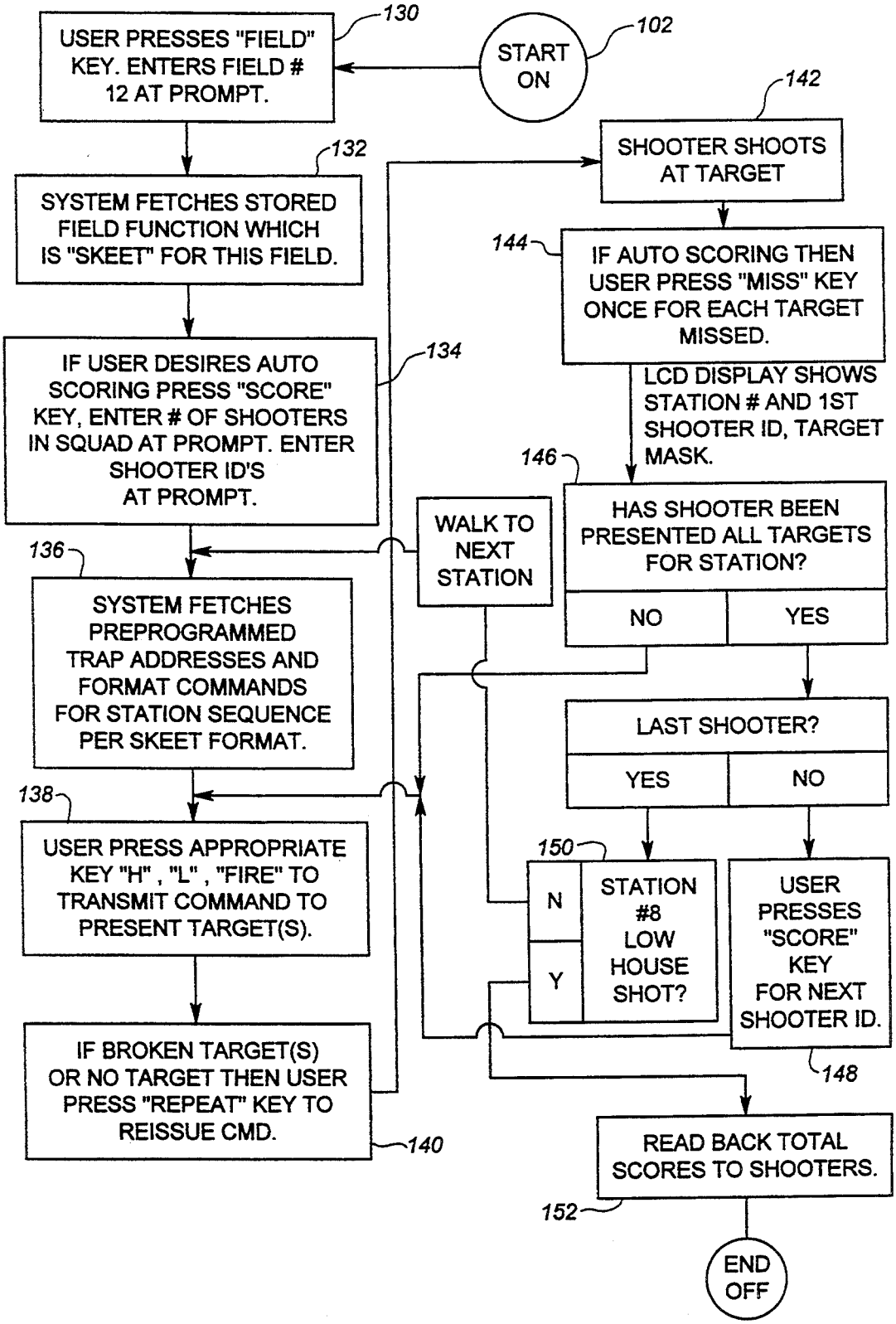
FIG. 6 is a top level flow chart illustrating an exemplary target presentation execution sequence for a skeet field.

FIG. 6 is a top level flow chart illustrating an exemplary target presentation execution sequence for a skeet field. The hand-held operator control module 12 is initiated by pressing the START ON/OFF key 102. The user then presses the FIELD key 130, and enters a field number. For purposes of the exemplary target presentation sequence of FIG. 6, field 12 has arbitrarily been selected.

The system 12 retrieves stored field function information for the particular skeet field 132 (e.g., field 12). If the user desires the auto-scoring function, the SCORE key is pressed followed by the number of shooters in the squad and an identification code for each shooter 134. The system 12 then retrieves preprogrammed trap addresses and skeet format commands for each station 136. Two targets are launched by pressing the FIRE key 138. Alternatively, a target may be launched from the high house by pressing the HIGH key or the low house by pressing the LOW key. If the target is broken or no target is launched, the user then presses the REPEAT key to reissue the command 140.

After the shooter has fired at the target 142, scoring is achieved by pressing the MISS key 144 once for each target missed. If additional targets remain to be presented to the particular shooter 146, the FIRE, HIGH, or LOW keys 138 are again pressed to initiate a target launch. Alternatively, the user presses the SCORE key 148 to notify the operator control module 12 that the target launch commands 138 will be initiated for a different shooter and the sequence is repeated for all shooters in a squad. Pressing the MANUAL key results in the next shooter being displayed. After the sequence is completed for all eight stations 150, the operator control module 12 displays the scores for each shooter 152.

FIG. 7 is a top level flow chart illustrating an exemplary target presentation execution sequence for a sporting clays course. The user presses the START ON/OFF key 102 to initiate the sequence. The user then presses the FIELD key and enters a field number 160. For purposes of the exemplary target presentation sequence in FIG. 7, field 15 has been arbitrarily chosen.

The system 12 then retrieves stored field function information consistent with this particular sporting clays field 162. As with the skeet field, the user then presses the SCORE key for auto-scoring, followed by the number of shooters in the squad and the identifications for each shooter 164. The user then presses the STATION key and enters the station number and number of targets at the prompt 166. The system 12 then retrieves preprogrammed trap addresses and station sequence formats 168. The FIRE key is pressed to launch targets 170. If the target is broken or no target is launched, the REPEAT key is pressed to reissue the command 172. After the shooter has fired on the target 174, the MISS key is pressed for each target missed 176. If the shooter has not yet been presented with all targets for a particular station 178, the user again presses the FIRE key 170. Alternatively, the user presses the SCORE key 180 to notify the control module 12 that the next shooter is prepared for the launch of a target 170. After all shooters have completed a particular station 182, the user then presses the STATION key for the next station 166. This sequence is repeated until all stations have been completed 184. Finally, the control module 12 displays the scores for each shooter 186.

FIG. 8 is a top level flow chart illustrating an exemplary target presentation execution sequence for a 5-stand sporting clays field. The sequence is initiated by pressing the START ON/OFF key 102. The user then presses the FIELD key and enters a field number 190. For purposes of the exemplary 5-stand sequence illustrated in FIG. 8, the field number 10 has been arbitrarily selected. The control module 12 then retrieves a stored field function for this particular 5-stand field 192. The user then enters the number of shooters, from 1 to 5, at the prompt 194. The SCORE key is pressed for auto-scoring, followed by the number of shooters in the squad and the shooter identifications 196. The control module 12 then prompts for the difficulty level for the sequence execution 198.

The control module 12 retrieves the trap addresses and format commands for a particular station per the NSCA 5-stand table 200, which has previously been incorporated by reference. The FIRE key is pressed to launch a target 202. If the target is broken or no target is launched, the user presses the REPEAT key to reissue the command 204. After the shooter has an opportunity to fire on the target 206, the user presses the MISS key for each target missed 208. The fire key 202 is pressed until all targets have been presented to a particular shooter. After all targets have been presented 210 the user presses the SCORE key 212 to repeat the fire sequence 202 for the next shooter. After all shooters in the squad have completed a particular station, the control module 10 retrieves the preprogrammed trap address and format commands for the next station 200, and the fire sequence 202 is repeated for each shooter at this particular station. After the last station has been completed 214, the control module 10 displays the scores for each shooter 216.

It will be understood that the exemplary embodiment in no way limits the scope of the invention. Other modifications of the invention will be apparent to those skilled in the art in view of the foregoing descriptions. These descriptions are intended to provide specific examples of embodiments which clearly disclose the invention. Accordingly, the invention is not limited to the described embodiments or to the use of specific elements, dimensions, materials or configurations contained therein. All alternative modifications and variations of the present invention which fall within the spirit and broad scope of the appended claims are covered.

What is claimed is:

1. A multi-function wireless target control system, comprising:

a hand-held operator control module for communicating commands to at least one target machine control module, the operator control module comprising;

a target control circuit connected to electromagnetic receiving and transmitting means contained within a housing for transmitting and receiving information between the operator control module and a target machine control module;

a user interface attached to the exterior of the housing for initiating electro-magnetic communication with the target control circuit, the user interface having input means for selectively controlling the at least one target machine control module, means for identifying and tracking a plurality of shooters, target launch sequence means for initiating the launch of targets from the at least one target launch machine, and means for recording a score for each shooter;

at least one target machine control module connected to at least one target launch machine for launching targets, the at least one target machine control module comprising;

electro-magnetic receiving means connected to a launch control circuit;

a target machine interface for transmitting launch commands from the launch control circuit to the target launch machine for launching targets according to the commands entered in the user interface.

2. The apparatus of claim 1 wherein the commands entered in the user interface comprises a preprogrammed target presentation sequences.

3. The apparatus of claim 1 wherein the user interface is a keypad and a display means.

4. The apparatus of claim 1 wherein the at least one target machine control module further includes electromagnetic transmitting means with a bi-directional protocol for transmitting scoring data to the hand-held operator control module.

5. The apparatus of claim 1 wherein the at least one target machine control module includes electromagnetic transmitting means and the radio frequency receiving and transmitting means includes a bi-directional protocol to return scoring data.

6. The apparatus of claim 1 wherein the electromagnetic receiving and transmitting means includes automatic retransmission means if commands are not properly received.

7. The apparatus of claim 1 wherein the hand-held operator control module includes a communication port for uploading and down-loading data from a central computer.

8. The apparatus of claim 1 wherein the electromagnetic receiving and transmitting means comprise a narrow band FM receiving and transmitting means.

9. The apparatus of claim 8 wherein the narrow band comprises 46–49 megahertz (MHz).

10. The apparatus of claim 1 wherein the target control circuit includes pre-programmed target launch formats.

11. The apparatus of claim 1 wherein the at least one target launch machine comprises a plurality of target launch machines and the control circuit prompts the user for the location of each of the target launch machines.

12. The apparatus of claim 1 wherein a plurality of operator control modules can interchangeably communicate with a plurality of target machine control modules.

13. A multi-function wireless target control system, comprising:

at least one hand-held operator control module for communicating commands to at least one target machine control module, the operator control module comprising;

a target control circuit connected to a radio frequency receiver and transmitter contained within a housing for transmitting and receiving information between the at least one operator control module and the at least one target machine control module;

a user interface comprising a keyboard and a display attached to the exterior of the housing for initiating radio frequency communication with the at least one target control circuit, the keyboard permitting the at least one target machine control module to be controlled, a plurality of shooters to be identified and tracked, the sequential launch of targets from the at least one target launch machine to be initiated, and scores of the shooters to be recorded;

at least one target machine control module connected to at least one target launch machine for launching targets, the at least one target machine control module comprising;

a radio frequency receiver and transmitter connected to a launch control circuit; and a target machine interface for transmitting launch commands from the launch control circuit to the target launch machine for launching targets according to the commands entered in the user interface.

* * * * *

UNITED STATES PATENT AND TRADEMARK OFFICE

CERTIFICATE OF CORRECTION

PATENT NO. : 5,427,380

DATED : June 27, 1995

INVENTOR(S) : Hazard et al.

It is certified that error appears in the above-identified patent and that said Letters Patent is hereby corrected as shown below:

Cover page, in Inventors section, delete "Tolman Jay" and insert therefor --Jan Tolman--.

Column 1, line 6, after "hand-held" insert --multi-function wireless target presentation control--.

Signed and Sealed this

Twenty-fifth Day of February, 1997

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,427,380

DATED : June 27, 1995

INVENTOR(S) : Hazard et al.

It is certified that error appears in the above-identified patent and that said Letters Patent is hereby *corrected as shown below:*

Cover page, Item [75] delete "Tolman Jay and insert therefor – Jay Tolman--.

Column 1, line 6, after "hand-held" insert – Multi-function wireless target presentation control--.

This certificate supersedes Certification of Correction issued February 25, 1997

Signed and Sealed this

Thirty-first Day of March, 1998

*Attest:*

Bruce Lehman

BRUCE LEHMAN

*Attesting Officer*

*Commissioner of Patents and Trademarks*